US005490712A

United States Patent [19]

Drelick

[11] Patent Number: 5,490,712

[45] Date of Patent: Feb. 13, 1996

[54] STORAGE OF ITEMS

[76] Inventor: Teresa M. Drelick, 7 Nelson Ave., Methuen, Mass. 01844

[21] Appl. No.: 707,288

[22] Filed: May 28, 1991

Related U.S. Application Data

[63] Continuation-in-part of Ser. No. 495,147, Mar. 19, 1990, abandoned.

[51] Int. Cl.[6] ..... A47C 7/62

[52] U.S. Cl. ..... 297/188.12; 297/188.13; 297/463.2

[58] Field of Search ..... 297/188, 189, 297/192, 193, 188.01, 188.08, 188.09, 188.1, 188.12, 188.13, 188.2, 463.2; 224/258, 151, 162; 383/22

[56] References Cited

U.S. PATENT DOCUMENTS

| | | | |
|---|---|---|---|
| 1,119,852 | 12/1914 | McVay | 224/220 |
| 1,927,751 | 9/1933 | Mensi | 383/24 X |
| 2,282,408 | 5/1942 | Lowe | 190/100 |
| 2,603,028 | 7/1952 | Roberts | 297/193 X |
| 2,673,601 | 3/1954 | Fischer | 297/192 X |
| 2,732,148 | 1/1956 | Lummis | 242/107 |
| 2,740,466 | 4/1956 | Du Priest | 297/188 |
| 2,865,433 | 12/1958 | Warner | 297/188 |
| 2,919,169 | 12/1959 | Jackson | 297/193 X |
| 2,982,455 | 5/1961 | Rosen | 297/192 |
| 3,198,300 | 8/1965 | Tuttle | 242/107 X |
| 3,316,951 | 5/1967 | Jacobson | 224/151 X |
| 3,623,683 | 11/1971 | Bennett | 297/192 X |
| 3,881,678 | 5/1975 | Quinn | 248/685 |
| 3,982,613 | 9/1976 | Wood | 242/107 X |
| 3,995,802 | 12/1976 | Johnston | 190/115 X |
| 4,240,480 | 12/1980 | Strobel | 383/22 X |
| 4,515,300 | 5/1985 | Cohen | 224/151 |
| 4,545,414 | 10/1985 | Baum | 190/115 X |
| 4,556,250 | 12/1985 | Chapman et al. | 297/192 |
| 4,799,731 | 1/1989 | Brown | 297/192 |
| 4,852,778 | 8/1989 | Beiser et al. | 224/258 X |
| 4,863,003 | 9/1989 | Carter | 297/188 |
| 4,887,751 | 12/1989 | Lehman | 190/1 X |

FOREIGN PATENT DOCUMENTS

| | | | |
|---|---|---|---|
| 1028376 | 5/1953 | France | 224/162 |
| 154391 | 12/1920 | United Kingdom | 297/193 |
| 174804 | 2/1922 | United Kingdom | 297/189 |
| 0602396 | 5/1948 | United Kingdom | 297/192 |
| 1561977 | 8/1975 | United Kingdom | 297/192 |
| 2077095 | 12/1981 | United Kingdom | 224/257 |

*Primary Examiner*—Milton Nelson, Jr.
*Attorney, Agent, or Firm*—George E. Kersey

[57] ABSTRACT

The method of temporarily storing items below a fixed position support by providing a container for the storage of items and strapping the container to the support below its lower surface with a strap that is narrower than the container and extends over the support from a connector on one side of the container to a connector on the opposite side of the container, with an upper surface of the container in contact with a lower surface of the support to permit the container with stored items to be held against a lower surface of the support and elevated above a ground or floor surface to avoid contact with dirt, debris or moisture that may be upon the floor or the ground; when the support is an occupied seat, a retractable cord extending from the occupant to the container can provide a reminder that items are in temporary storage below the seat, so that when the occupant decides to leave the vicinity of the seat, a pull is exerted by the cord against the occupant.

6 Claims, 3 Drawing Sheets

STORAGE OF ITEMS

This is a continuation-in-part of Ser. No. 07/495,147 filed Mar. 19, 1990 and now abandoned.

BACKGROUND OF THE INVENTION

This invention relates to the storage of items and more particularly to the temporary storage of items below a seat or chair.

The ordinary seat or chair does not have any provision for the storage of items. As a result, ordinary items that accompany a person must be placed either below the seat in a disarrayed condition or occupy a separate parcel package that often does not fit under the seat, particularly in congested locations such as a movie theater or stadium.

Accordingly, it is an object of the invention to facilitate the storage of miscellaneous items, particularly those that are not already enclosed in a container. A further object is to facilitate the storage items such as pocketbooks, glasses and the like which accompany the user to various social and athletic functions.

Another object of the invention is to take advantage of the storage area that is provided below the seat of a user, but is not intended for permanent storage and has no regular provision for storage.

Another object of the invention is to store items in such a way that they do not interfere with passageways, neighboring seats and the like.

A still further object of the invention is to provide for the storage of miscellaneous items at social and athletic functions in a way that does not lead to contamination or confusion. At athletic and social functions beverages and food items are circulated among patrons and there can be inadvertent spillage upon items of personal property.

In addition, in many stadiums and convention halls the regions below chairs or seats are occupied by debris, or may have an accumulation of dirt that could have an adverse effect on items in storage.

Another problem that confronts the attendee at athletic and social events is that an item placed under or beside a seat can be forgotten after the event has concluded.

Accordingly, it is another object of the invention to guard against the inadvertent failure to retrieve items that are temporarily placed under or beside the seat at an athletic or social event.

While the concept of underneath storage is known, the known art has a number of disadvantages. Thus, U.S. Pat. No. 4,527 830 which issued to Robert A. Meyers on Jul. 9, 1985 discloses a storage compartment of fixed size with a seat as an integral part of the storage unit.

Such a unit is not adaptable to a general subseat storage because the storage compartment can be accomodated only by a sub-seat space having prescribed dimensions. In addition, the device duplicates the seat and thus does not have the flexibility that is needed. In particular, there is no way to adjust the storage unit to the space available below an ordinary seat or chair. In effect, there is no more than the combination of a suitcase-like device to which there is a hinged member that serves as a back.

Accordingly, it is a further object of the invention to overcome the difficulties and the shortcomings that are associated with storage devices of the kind exemplified by the prior art.

SUMMARY OF THE INVENTION

In accomplishing the foregoing and related objects the invention provides a method of temporarily storing items below the lower surface of a support by providing a container for the storage of the items and strapping the container to the support below the lower surface. The container desireably has flexible walls to economize upon the storage and handling of the container before it is placed in use and further provide flexibility for the storage of a large number of items, with a capability for expansion of the container. The container advantageously is fabricated from a flexible and expandable material to provide a storage unit of relatively small scale and volume until items are intended to be stored, and thereafter permit the expansion of the container to accommodate a wide variety of items.

In accordance with one aspect of the method the container is strapped to the support with the upper container surface in intimate contact with the lower surface of the support. This permits the storage container to be held against the lower surface of the support and above ground or floor to avoid contact of the container and thus guard against the attraction of dirt or debris from the floor and also guard against inadvertent contact with moisture that may be spilled upon the floor or ground.

In accordance with a further aspect of the invention the container has a reclosable opening that is positioned against the lower surface of the support. This provides security against the unauthorized opening of the container while the owner is at an athletic or social event and the container is in storage position.

In accordance with another aspect of the invention the strapping is adjustable and can be retractable. This facilitates the attachment of said container to the underside of said support and simultaneously provides a capability for the rapid release of the strapping to facilitate the removal of the container from below the support.

In accordance with a further aspect of the method, a connector is provided between the user and the container positioned below the support. This serves to remind the user that the container is in storage position and guard against the inadvertent departure of the user from the stadium or social event without retrieving the container and the stored items. The connection can be formed by a retractable cord that is attached to the user at one end and to the container at the other end.

In storing items below a support having upper and lower surfaces, the invention provides a container for items to be stored, and means for strapping the container to the support below its lower surface. The support can take the form of a retractable seat of the kind found in movie theaters and sport stadiums. The container is strapped to the seat, either in its up-right folded position or in its downward position. A suitable container is a flexible bag with retention rings at opposite ends of the surface that contacts the support. This provides a facility for strapping the container to the support and also provides a retention device by which the container can be carried on the shoulder or by hand. A removable strap for securing the container to the support extends from one edge of the container to an opposite edge. The strap can be retractable.

In accordance with a still further aspect of the invention the strap includes a snap-fit buckle. In addition, the container includes a reclosable opening on an upper surface below the strap by which the container is afixed to a support. The reclosable opening can be provided by a zipper that extends along the strap by which the container is temporarily fixed to the support.

In accordance with apparatus for reminding a user that an object or other item has been placed temporarily in a storage position, a connector is provided that is capable of extending from the user to the item that is temporarily stored. The connector desireably is retractable either to the stored item or to the body of the user. The connector can be a retractable cord that is extendable from a housing, on either the stored unit or the user.

DESCRIPTION OF THE DRAWINGS

Other aspects of the invention will become apparent after considering several illustrative embodiments taken in conjunction with the drawings in which.

DETAILED DESCRIPTION

Figure 1:
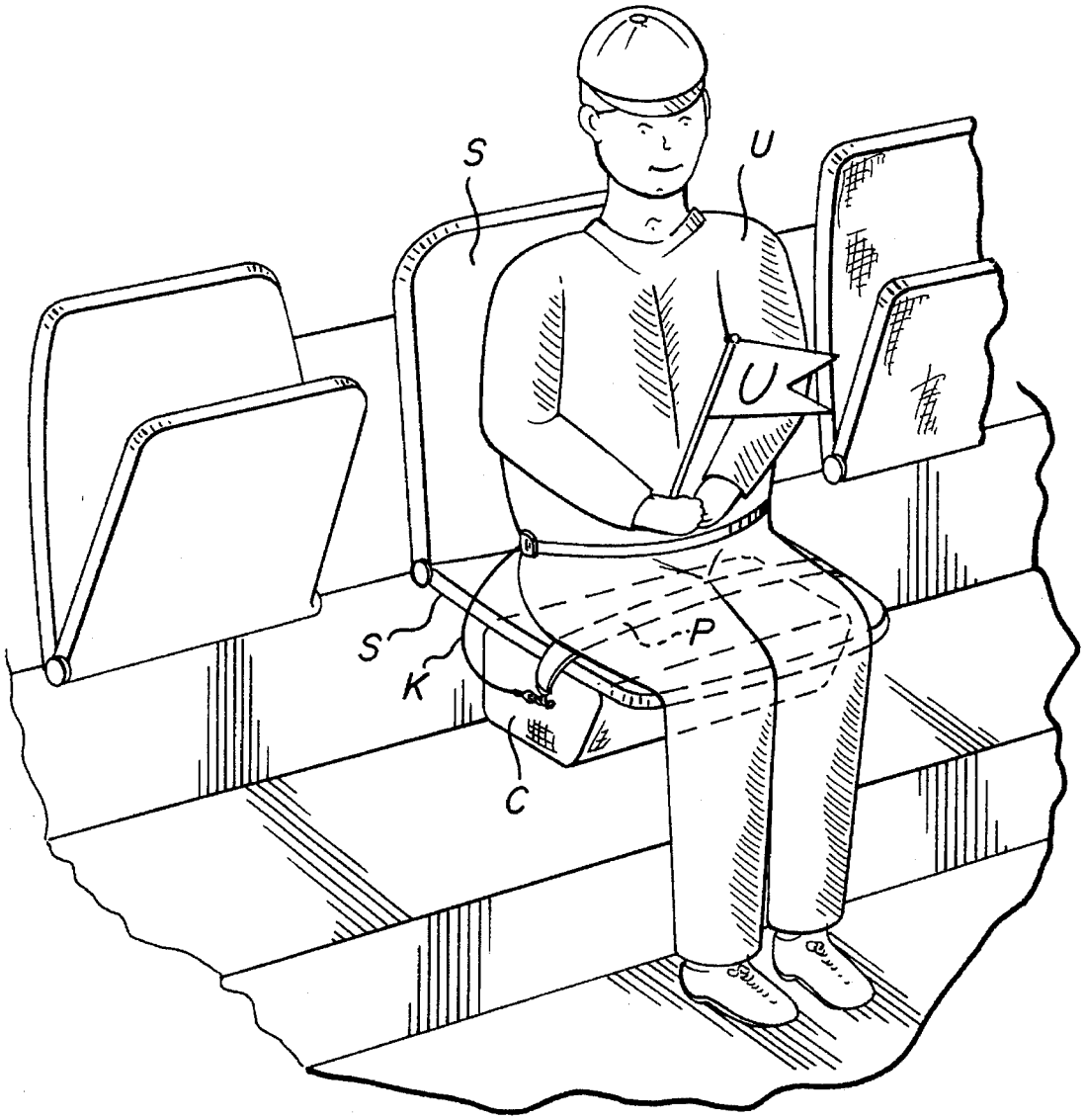
FIG. 1 is a perspective view showing a seated user and a sub-seat storage container in accordance with the invention.

With reference to the drawings, a perspective view showing a typical seat S in a stadium, or public arena, is illustrated in FIG. 1. The seat S is may be pushed downwardly from its retracted rest position to afford a rest position for the user U. Typically this is accomplished by simply pressing down at the forward edge of the seat allowing the user U then to sit on the seat and hold it in its downward extended position.

In addition, as shown in FIG. 1 the seat S has positioned on its underside, a flexible and temporary storage compartment C in accordance with the invention. The temporary storage compartment C is strapped to the seat S by an elongated adjustable strap, for example, of nylon. The ways in which the adjustments can be made in the strap are described in further detail below. In FIG. 1 the strap has been tightened so that the upper surface of the flexible and temporary storage compartment C is positioned against the lower surface of the seat S.

Because of the contact of the upper part of the temporary storage compartment C with the lower portion of the seat S, the temporary storage compartment C is elevated above the floor associated with the seating structure. As a result, there is no contact of the temporary storage compartment C with dirt and debris or other refuse that might be on the floor in the vicinity of the user U.

As seen in FIG. 1, an elastic or retractable cord K interconnects the user U with the temporary storage compartment C.

Figure 2:
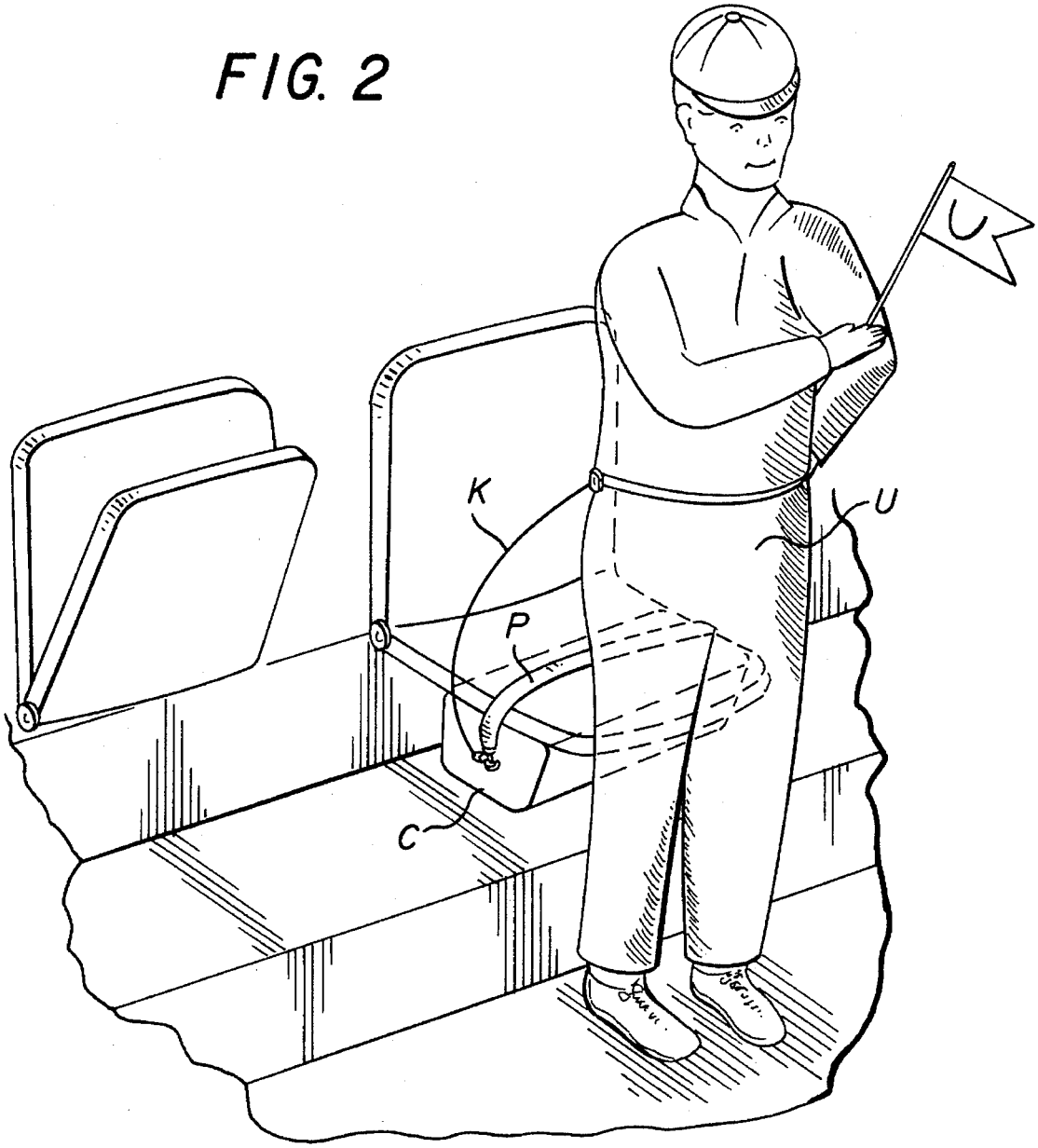
FIG. 2 is a perspective view of FIG. 1 with the user unseated.

When the user U rises from the seat S, as shown in FIG. 2, the elastic or retractable cord extends. When the limit of extension is reached, there is a gentle tug on the user U that serves as a reminder that a temporary storage compartment C is located beneath the seat S.

Figure 3A:
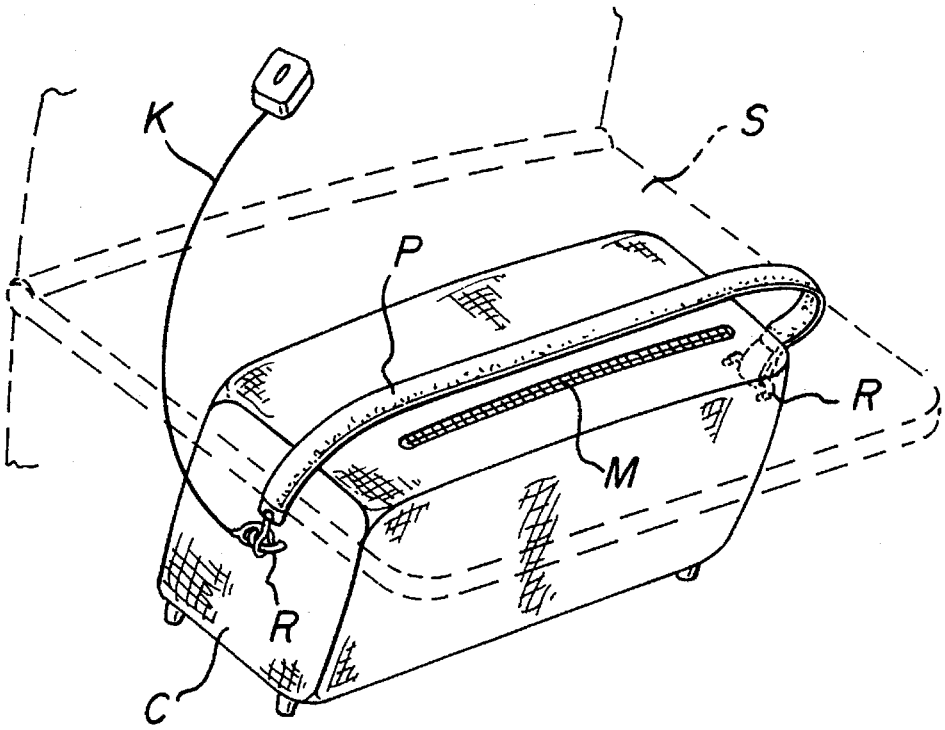
FIG. 3A is a perspective view of a portion of the sub-seat storage container of FIGS. 1 and 2.

A further view of the temporary storage container C is shown in FIG. 3A. As indicated, the temporary storage container C is made of flexible material so that it can be easily folded or compressed to occupy a limited amount of space until it is ready for usage.

Figure 3B:
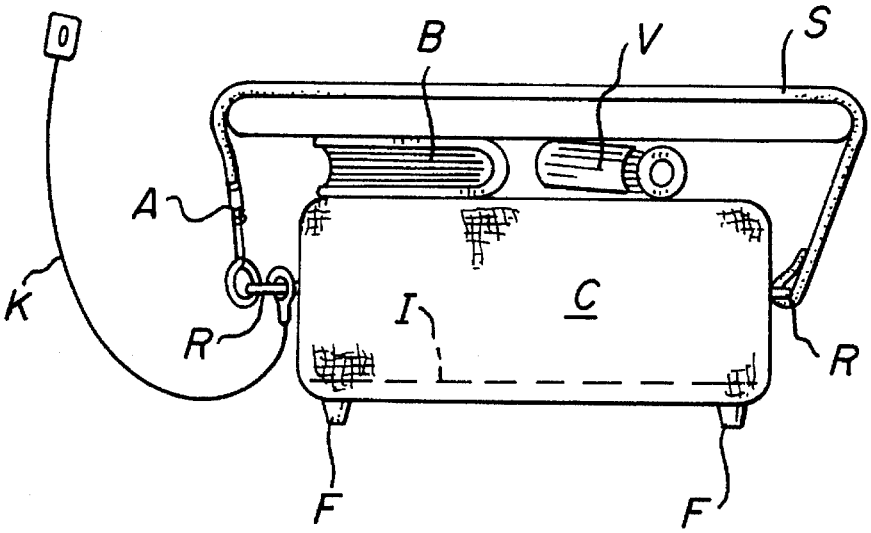
FIG. 3B is a front view of an alternate subseat storage arrangement in accordance with the invention.

In addition, as shown in FIG. 3B, a set of feet F is provided at the lower corners of the compartment C to provide a separation between ground surface and the base of the compartment C before the compartment C has been strapped into position beneath a seat S. To accomodate those situations where it is desired to leave a space between the lower portion of the seat S and the storage container C, the strap P is adjusted accordingly. The slack or the space that is provided between the lower surface of the seat S and the upper surface of the storage container C can be used for other purposes. For example, this space can be occupied by periodicals or even by articles of clothing and other items that may be too large to fit into the storage container C. Because the strapping P is adjustable, once the space between the container C and the seat S is filled as desired, the strapping P can be tightened to securely position the retained items against the lower surface of the seat S.

As seen in FIG. 3A, entry into the storage compartment C is by way of a reclosable member M. This reclosable member M is on the upper surface of the storage compartment C so that when the strap P is tightened, with the storage compartment C securely positioned against the lower surface of the seat S, unauthorized access to the interior of the storage compartment C is not possible.

A convenient reclosable member M for sealing the compartment is a zipper. However, other forms of closure may be used as well, such as those provided by VELCRO tape.

With respect to the strapping P itself, it can be made adjustable by being formed from a belt of nylon that is inserted into rings R at opposite edges of the storage compartment C with the parts that extend through the rings R, foldable upon each other and sealable, for example, by material such as VELCRO fastener (not shown). Alternatively, the adjustable strap P may be seat-belt-like in construction, with a buckle that is inserted into one of the rings. When a release mechanism on such a buckle is depressed, the tongue can retract towards a spring loaded housing which may be attached at the opposite end of the storage compartment C, in the vicinity of the ring R that ordinarily would be used to retain the strap P. The strap S is adjustable in conventional fashion using, for example an adjusting buckle.

The temporary storage compartment may be fabricated from a fabric bag with a stiff insert. Other suitable components include an adjustable strap, a retractable cord, a rewinding spring mechanism and a zipper, springs and clips.

The retraction feature and the spring-loaded housing are shown in FIG. 3B at the end of the cord K, and at the end of the strap P. The mechanism for the housing is detailed in the cited prior art of Wood U.S. Pat. No. 3,982,613 (issued Sep. 28, 1976) "Retractable Pull Strap" and Tuttle U.S. Pat. No. 3,198,300 (issued Apr. 3, 1965) "Handle Having Retractable Strap".

The invention includes the method of temporarily storing items below a support having an outwardly extending axis and a side or transverse axis, with a lower surface spaced from an upper surface. The steps include (a) providing a container for the storage of the items; and (b) strapping the container to the support below the lower surface by a strap that is narrower than either the length of the outwardly extending axis or the transverse axis of the support and extends over the upper surface at an angle with respect to the outwardly extending axis of the support.

In accordance with one aspect of the method, the container has flexible walls, the support is a seat for supporting the weight of a user and the angle between the extension of the strap and the outwardly extending axis of the support exceeds zero degrees to economize upon the storage and the handling of the container before it is placed in use, and further to provide flexibility for the storage of a large number of items and provide a capability for expansion of the container. The container can be fabricated from a flexible and expandable material and the angle between the strap and the outwardly extending axis of the support is about ninety degrees. This provides a storage unit of relatively small scale and volume until items are intended to be stored and thereafter permits the expansion of the container to accomodate a wide variety of items.

The method also provides that the container is strapped to the support by extending the strap over one side of the container, over the support and then to a connector on the opposite side of the container, with the upper surface of the container in intimate contact with the .lower surface of the support to permit the storage container to be held against the lower surface of the support and elevated above the ground surface to avoid contact of the container with the ground or floor and thus guard against the attraction of dirt or debris from the floor and also to guard against inadvertent contact with moisture that may be spilled upon the floor or the ground.

In accordance with the method, the container can have a reclosable opening completely surrounded by an within a container wall that is completely positioned against the lower surface of the support to provide security against the unauthorized opening of the container while the user is occupied at an athletic or social event and the container is in storage position. The strapping can be adjustable and is retractable after being connected to the container to draw the container spontaneously against the support. This is to facilitate the attachment of the container to the underside of the support and simultaneously provide a capability for the rapid release of the strapping to facilitate the removal of the container from below the support.

A connector can be provided between the wearing apparel of the user and the container positioned below the support, so that when the user moves away from the container the connector provides a tug on the user. This is to remind the user that the container is in storage position and guard against the inadvertent departure of the user from the stadium or social event without retrieving the container and the stored items.

The connection can be formed by a retractable cord that extends from a housing attached to the user at one end and is temporarily attached to the container at the other end.

In apparatus for storing items below a single support having upper and lower surfaces, a container for items to be stored is provided along with means for strapping the container below the lower surface of the support by a strap having a width narrower than that of the support and extending over the support. The support can be a retractable seat of the kind found in movie theaters and stadia, and the container is strapped to the seat by positioning the container against the seat and extending the strapping means from one side of the container over the seat and connecting said strapping means to the container, either when the seat is in its up-right folded position or in its downward position ready to receive the weight of the person who is to occupy the seat.

The container can be a flexible bag with a linear reclosable opening. The container can have a surface with retention rings at opposite ends of the surface for contacting the support with the reclosable opening against the support to provide a facility for strapping the container to the support and also provide a retention device by which the container can be carried on the shoulder or by hand by the user.

The strapping can be a narrow removable strap for securing the container to the support and extending from one edge of the container to an opposite edge of the container. The strapping can be retractable from one side of the container to an opposite side. The strapping can include a snap-fit buckle.

The container also can include a reclosable opening on an upper surface of the container directly below the strapping by which the container is affixed to the support. The reclosable opening can be provided by a zipper that extends along and faces the strap by which the container is temporarily fixed to a support.

In apparatus for reminding a user that an object or other item has been placed temporarily in a storage position, a connector is used that is capable of extending, from within a housing on the body of the user, to the item that is temporarily stored, and means are provided for retracting the connector to the the body of the user. The connector can be a spring-loaded retractable cord that can be extended from a housing on the user to the opposite item.

The bag can be constructed from a variety of fabrics, including a blend of fibers. A suitable blend material is nylon which has high abrasion resistance, washes easily and holds its shape well and does not stretch or shrink. In addition, nylon possess excellent wet-strength, dries quickly and is not attacked by mildew.

Another suitable material is the fabric that is sold under the tradename "ACRILAN", which is an acrylonitile copolymer. Acrylics have the formula $R{=}C_3H_4O_2{-}$ and are obtained by the oxidation of acrolein, a pungent liquid formed as a decomposition product of glycerol and glycerides, $C_3H_4O$. Nitriles are organic cyanides, RCN, where "R" is as stated above. Polyacrylonitriles have outstanding resistance to sunlight, are not affected by mildew and not harmed by bleaches. In addition, they have suitable abrasion resistance, low absorption and dry rapidly. It also is resistant to wrinkling.

While less suitable cotton or a cotton-blend also can be used. Cotton shows little or no deterioration with proper care. In general, any material is suitable that wears well, withstands high temperatures and is easily cleaned. Where it is desired to have a firm base for the container C, an insert of plastic or fiberboard may be used.

Suitable plastics include polypropylene which has good flexural strength and is resistant to chemicals. Also suitable are styrenes such as "ABS", which is a tough, high-impact plastic with good chemical resistance, toughness and impact strength. In general, styrene plastics are derived from a yellowish aromatic liquid $C_6H5_oCH{-}CH_2$. Polyethylene may also be employed. This is a thermoplastic resin $(C_2H_4)_n$ made my polymerization of ethylene to produce a translucent and light-weight material. Although polyethylene is generally softer and more flexible than polypropylene it can be made hard and rigid. A further material is polyvinylchloride which is either rigid or flexible, with electrical resistance, outdoor stability and resistance to moisture.

The base may be "fiberboard" which is a composite of wood fibers, sawdust and chips, together with vegetable matter and fillers. The composite is pressed into individual boards. A similar material is plywood which is fiberboard bounded by thin layers of wood.

In addition to nylon, the strapping P may be of polyester which is a polymeric resin formed by condensing polyhydric alcohols with dibasic acids. Other plastic resins such as polypropylene may be used. Nylon, which is a hexamide containing the $CO{-}NH_2$ radical, is a particularly strong having test strengths of 4,000 to 10,000 pounds. Nylon straps will not shrink or deteriorate and are impervious to oil, gasoline and other chemicals. Polypropylene strapping has strength, versatility and is impervious to moisture and common chemicals.

In general, any seat may be used for the practice of the invention, whether the seat has fixed legs or is retractable as shown in FIGS. 1 and 2 above. No matter what its type, the seat serves to provide a suitable space between a floor or ground surface for affixation of a temporary storage compartment in accordance with the invention.

I claim:

1. The method of temporarily storing items below a fixed position support having a lower surface spaced from an upper surface, which comprises the steps of:

(a) providing a container for the storage of the items; and (b) strapping said container to said support below said lower surface by a strap that is narrower than said container and both the outward and transverse lengths of said support from its fixed position, and extends over said upper surface at an angle with respect to the outwardly extending length of said support;

further including the method for temporarily storing items with a reminder that the items have been temporarily stored, wherein the support comprises a seat having upper and lower surfaces and extending outwardly above a floor from a back and the container comprises an elongated storage bag having an upper surface containing a reclosable opening and a strap extendable along said reclosable opening, and said container is placed below said seat with the direction of elongation of said container transverse to the direction of the outward extension of said seat and said container is strapped to said seat by extending said strap over said seat above said reclosable opening facing the lower surface of said seat, comprising the steps of;

(c) elevating said container above said floor with said reclosable opening facing the lower surface of said seat;

thereby to reduce the incidence of contamination of said container by dirt and debris on said floor and further provide increased security against the unauthorized opening of said reclosable opening while said items are stored therein, and (d) positioning a retractable cord on an occupant for said seat and extending said cord to said container;

thereby to provide a reminder to said occupant of said seat that said items are in temporary storage below said seat when said occupant decides to leave the vicinity of said seat, by a pull exerted against the occupant by said cord.

2. The method of temporarily storing items below a fixed position support having a lower surface spaced from an upper surface, which comprises the steps of:

(a) providing a container for the storage of the items; and (b) strapping said container to said support below said lower surface by a strap that is narrower than said container and both the outward and transverse lengths of said support, and extends over said upper surface at an angle with respect to the outwardly extending length of said support;

wherein said container has opposite sides and is strapped to said support by extending said strap from a connector on one side of said container, over said support and then to a connector on the opposite side of said container, with the upper surface of said container in contact with the lower surface of said support;

thereby to permit the storage container to be held against the lower surface of the support and elevated above the ground surface to avoid contact of the container with the ground or floor and thus guard against the attraction of dirt or debris from the floor and also to guard against inadvertent contact with moisture that may be spilled upon the floor or the ground.

3. The method of temporarily storing items below a fixed position support having outwardly extending and transverse lengths, with a lower surface spaced from an upper surface, which comprises the steps of:

(a) providing a container for the storage of the items; and (b) strapping said container to said support below said lower surface by a strap that is narrower than said container and both the outwardly extending and transverse lengths of said support from its fixed position, and extends over said upper surface at an angle with respect to the outwardly extending length of said support;

wherein said container has a reclosable opening included completely within a container wall and positioned against the lower surface of said support;

thereby to provide security against the unauthorized opening of said container while said user is occupied at an athletic or social event and said container is in storage position.

4. The method of temporarily storing items below a fixed position support having outwardly extending and transverse lengths, with a lower surface spaced from an upper surface, which comprises the steps of:

(a) providing a container for the storage of the items; and (b) strapping said container to said support below said lower surface by a strap that is narrower than said container and both the outwardly extending and transverse lengths of said support, and extends over said upper surface at an angle with respect to the outwardly extending length of said support;

wherein said strapping is adjustable and is retractable after being connected to draw said container spontaneously against said support;

thereby to facilitate the attachment of said container to the underside of said support and simultaneously provide a capability for the rapid release of said strapping to facilitate the removal of said container from below said support.

5. The method of temporarily storing items below a fixed position support having outwardly extending and transverse lengths, with a lower surface spaced from an upper surface, which comprises the steps of:

(a) providing a container for the storage of the items; and (b) strapping said container to said support below said lower surface by a strap that is narrower than said container and both the outwardly extending and transverse lengths of said support, and extends over said upper surface at an angle with respect to the outwardly extending length of said support;

wherein a connector is provided between wearing apparel of a user and the container positioned below said support so that when the user moves away from the container the connector provides a tug on the user;

thereby to remind the user that the container is in storage position and guard against the inadvertent departure of the user from the stadium or social event without retrieving the container and the stored items.

6. The method of claim 5 wherein the connector is a retractable cord that extends from a housing attached to the user at one end and is temporarily attached to the container at the other end.

* * * * *